United States Patent [19]

Swanberg

[11] Patent Number: 4,470,502

[45] Date of Patent: Sep. 11, 1984

[54] SHADOW BOX ADAPTED TO BE END-LOADED

[75] Inventor: Robert H. Swanberg, Montvale, N.J.

[73] Assignee: Union Camp Corporation, Wayne, N.J.

[21] Appl. No.: 523,138

[22] Filed: Aug. 15, 1983

[51] Int. Cl.[3] ..... B65D 5/50; B65D 5/48

[52] U.S. Cl. ..... 206/45.14; 206/45.31; 229/27

[58] Field of Search ..... 206/45.14, 45.15, 45.19, 206/45.33, 45.34, 45.31, 583; 229/27

[56] References Cited

U.S. PATENT DOCUMENTS

| | | | |
|---|---|---|---|
| 3,942,710 | 3/1976 | Collie | 206/45.31 |
| 4,037,717 | 7/1977 | Roccaforte | 206/45.31 |
| 4,113,086 | 9/1978 | Forbes, Jr. | 206/45.31 |
| 4,264,006 | 4/1981 | Swanberg | 206/45.31 |
| 4,424,897 | 1/1984 | Ondris et al. | 206/45.31 |

*Primary Examiner*—Joseph Man-Fu Moy

*Attorney, Agent, or Firm*—Kane, Dalsimer, Kane, Sullivan and Kurucz

[57] ABSTRACT

A shadow box with an inner central panel having an inner bottom panel, the said inner central panel providing a recess to receive a product, the said inner bottom panel facilitating the insertion of the product into the bottom of the carton by machine and reinforcing the bottom closure when the carton is closed, and the closed carton securely holding the displayed product during shipment and handling.

6 Claims, 7 Drawing Figures

FIG. 5
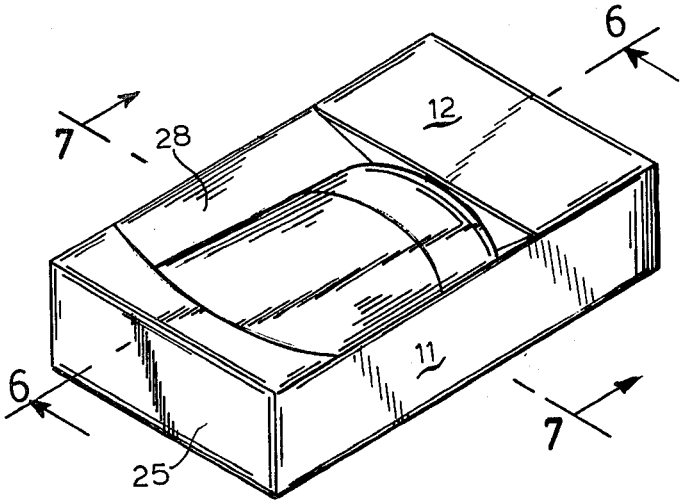
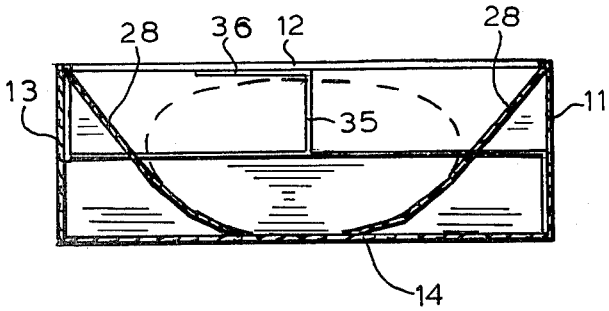
FIG. 7
FIG. 6
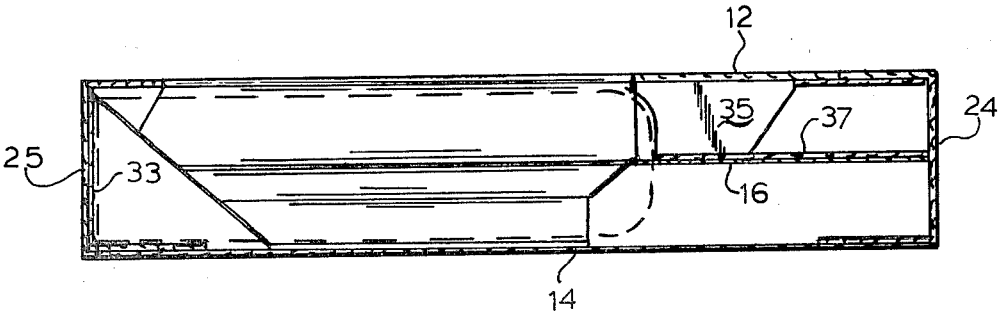

SHADOW BOX ADAPTED TO BE END-LOADED

BACKGROUND OF THE INVENTION

1. Field of the Invention

This invention relates to an improvement in folding cartons and more particularly to a shadow box so constructed that it can be loaded from the bottom by hand or machine, supports the base of the product packaged in the box, holds the product from falling out of the package during shipment, handling and display, and provides more display surface on the front face of the box.

2. Brief Description of the Prior Art

Shadow boxes to support the product packaged in the boxes are old and well known. Most such shadow boxes on the market are top- or face-loaded. The shadow box of the present invention is adapted to be bottom-loaded automatically by machine, supports products of different shape, rigidly retains the product in a fixed position in the frame of the box, and provides other advantages not found in the prior art boxes.

SUMMARY OF THE INVENTION

The invention covers a shadow box formed from a precut and prescored blank for holding and displaying a product, the said box comprising:

- front, back and side panels interconnected to form a hollow body;
- top and bottom closure panels and flaps;
- an inner central panel interposed between front and back panels, the central panel being cut out to provide an opening conforming generally to the shape of the product inserted into the box, with the lower portion of the said panel being hinged so that the panel and opening form a recess for the bottom of the product inserted in the box;
- an inner bottom panel connected to the inner central panel which provides means to raise the inner central panel for insertion of the product into the bottom of the box and also serves to reinforce the bottom closure when the panel is folded into the bottom closure flaps; and
- a stop to contact the top of the product and prevent it from vertical movement of the product in the box,
- the front panel being cut out to provide a top edge, a bottom edge and vertical flaps to form a frame to display the product in the box, the said top edge extending below the top of the product and the bottom edge extending above the bottom of the product so that the product is held at top and bottom within the box.

BRIEF DESCRIPTION OF THE DRAWINGS

In the drawings:

FIG. 5 is a perspective view of the shadow box of the present invention with the product in the box and the top and bottom flaps closed;

FIG. 6 is a cross-sectional view of the box of FIG. 5 taken along section line 6—6 of FIG. 5; and FIG. 7 is a cross-sectional view of the box of FIG. 5 taken along section line 7—7 of FIG. 5.

DESCRIPTION OF THE PREFERRED EMBODIMENT

Figure 1:
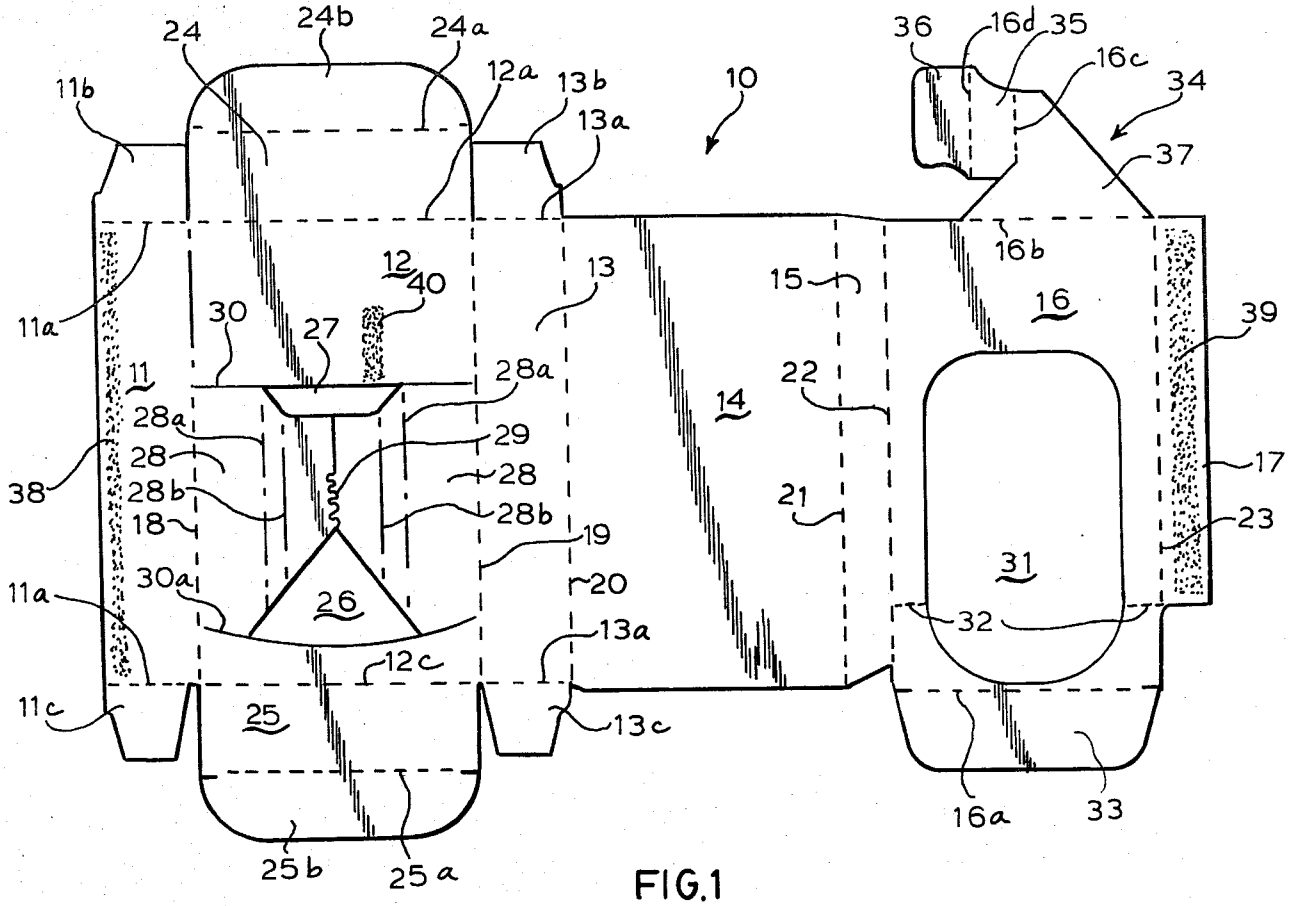
FIG. 1 is a plan view of the blank for the shadow box embodying the present invention.

Referring to the drawings, there is shown in FIG. 1 a blank 10 of sheet material such as paperboard used for folding cartons, of a weight suitable for the type of carton to be constructed. The blank 10 consists of a first side panel 11, front panel 12, second side panel 13, back panel 14, inner first side panel 15, inner central panel 16 and inner second side panel 17, which panels are connected respectively along hinge score lines 18, 19, 20, 21, 22 and 23. Connected to the first side panel 11 along hinge score lines **11*a* are top and bottom side closure flaps 11*b* and 11*c*. Similarly, there are connected to the second side panel 13 along hinge score line 13*a* top and bottom side closure flaps 13*b* and 13*c***.

Connected to the top of the front panel 12 along hinge score line **12*a* is a top panel 24 to which is connected a back closure flap 24*b* along hinge score line 24*a*. Similarly there is connected to the front panel 12 along hinge score line 12*c* a bottom panel 25 to which is connected a back closure flap 25*b* along hinge score line 25*a*. The front panel 12 is cut along lines 30 and 30*a* and cut out in the center area to provide a V-shaped opening 26, a U-shaped opening 27, and side frame members 28. At this stage the two side frame members 28 are connected to each other along a perforated line 29, but when set up for insertion of the product such side frame members are separated from each other. The side frame members 28 are provided with vertical score lines 28*a* and 28*b*** so that such members can be curved when the product rests on the members.

The inner central panel 16 is cut out in the center area to provide an opening 31 conforming generally to the shape of the product inserted in the box. On each side of the opening 31 at the lower portion of the panel 16 there are score lines 32 so that the panel and opening will form a recess for the bottom of the product inserted in the box. Connected to the bottom of the inner central panel 16 along hinge score line **16*a* is an inner bottom panel 33. As will be more fully explained hereinafter, this panel 33 facilitates the insertion of the product into the box by machine by permitting the bottom of the inner central panel 16** to be moved out of the way for insertion of the product into the frame. Furthermore, after the product has been packaged in the box this inner central panel provides additional reinforcement for the bottom closure and retains the bottom of the product in the lower portion of the frame.

Connected to the top of the inner central panel 16 along hinge score line **16*b* is a stop panel assembly 34 which is cut and scored along lines 16*c* and 16*d* to provide a stop 35 with a portion conforming to the shape of the top of the product inserted in the box and a first support 36. When the box is set up this stop runs from the front panel 12 to the inner central panel 16. In this assembly the stop 35 is held in position by first support 36 adhesively secured to the front panel 12 and a second support 37 resting against the inner central panel 16**.

It will be understood that this stop assembly can be eliminated where the product extends the full length of the box or where the configuration of the product will keep the product within the opening 31 of the inner central panel 16.

The manufacturer of the blank glues the blank so that it can be shipped flat to the packager. Although the blank can be set up, filled by hand, this particular blank is adapted and constructed so that a machine can set up the blank into a box, close the top closure flaps, insert the product into the box, and then close the bottom closure flaps to complete the operation.

Figure 2:
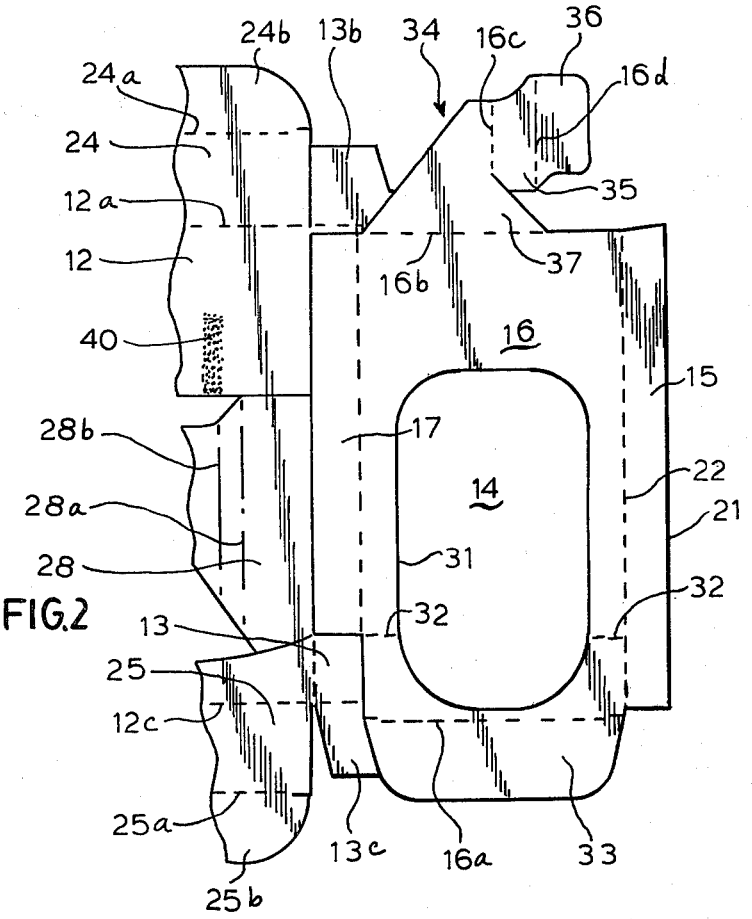
FIG. 2 is a plan view of a portion of the blank of FIG. 1, showing the inner central panel and the top stop panel assembly.
Figure 3:
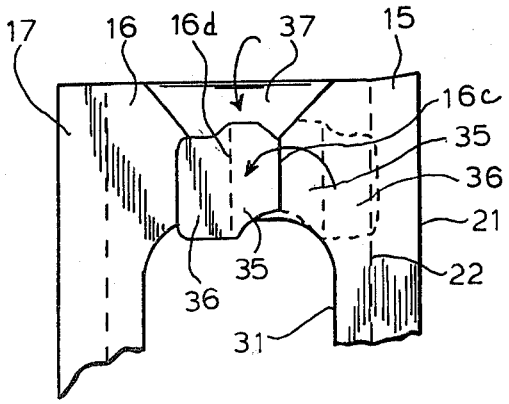
FIG. 3 is a plan view of a portion of the blank of FIG. 1 showing the top stop panel assembly folded into position prior to the formation of the blank into a tube.

In the gluing operation the manufacturer applies to the inner surface of the blank a line of glue 38 along the outer edge of first side panel 11, a line of glue 39 to inner second side panel 17, and a line of glue 40 to the front panel 12 for the stop panel assembly (FIG. 1). The blank is then reverse folded along the score line 21 so that the inner central panel 16 and the inner first and second side panels 15 and 17 will be superimposed over the back panel 14 and the second side panel 13 (FIG. 2.) The line of glue 39 will bond the inner second side panel 17 to the second side panel 13. The stop panel assembly is now reverse folded along the score line **16*b* so that the stop assembly is superimposed over the outer surface of the inner central panel 16 (FIG. 3). The stop panel assembly is now reverse folded along the line 16*c* so that the stop 35 and first support 36 overlie the second support 37 (FIG. 3). The blank is now reverse folded along the score line 19 so that the front panel 12 and first side panel 11 are superimposed over the stop panel assembly, inner central panel 16 and inner first and second side panels 15 and 17. The line of glue 38 will bond the edge of first side panel 11 to the outer surface of first inner side panel 15 and the line of glue 40 will bond the inner surface of the first support 36 of the stop assembly to the inner surface of the front panel 12**. This will complete the manufacturer's operation. The glued blank is now in flat condition ready for shipment to the packager.

Figure 4:
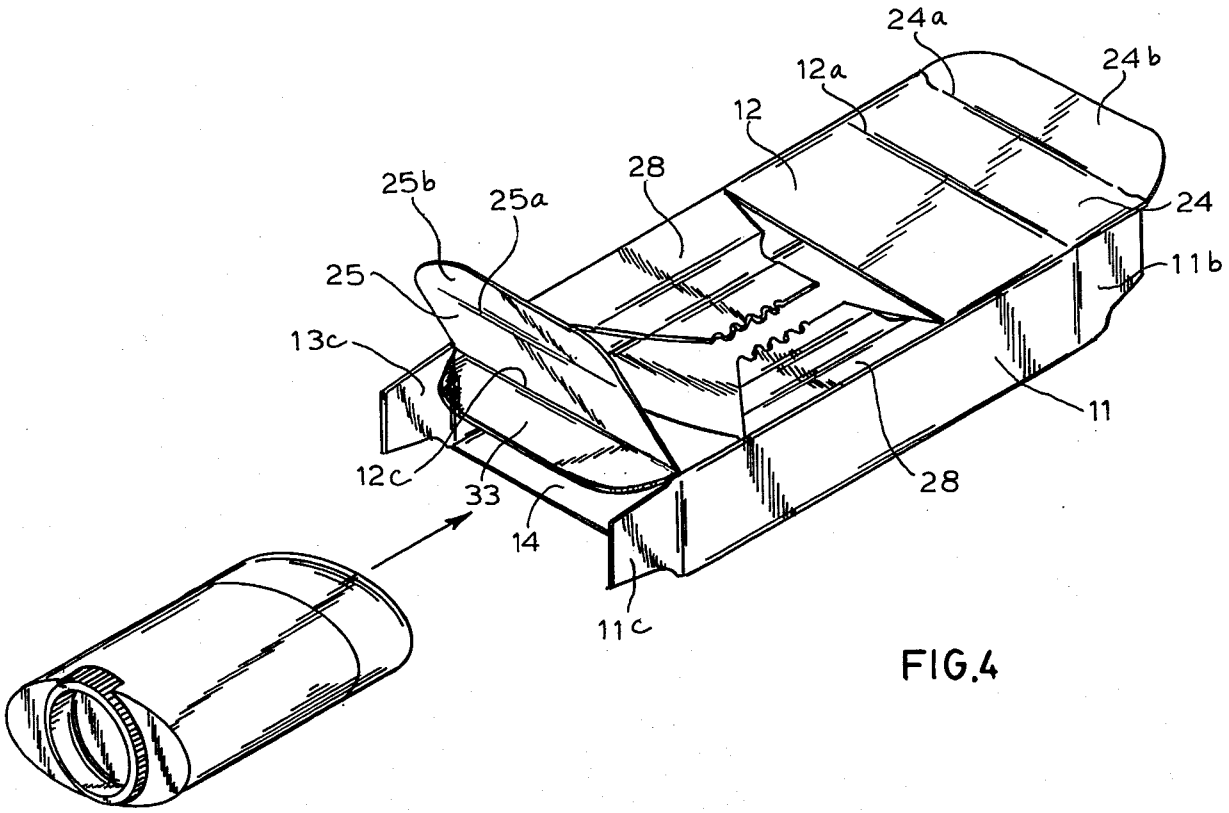
FIG. 4 is a prespective view of the blank of FIG. 1 set up as a box prior to the closure of the top flaps and insertion of the product into the bottom of the box.

The packager sets up the blank into the form of a box open at both ends (FIG. 4). The top panel and flaps are closed which serves to hold the box in open condition. The side frame members 28, connected along the perforated line 29, are separated from each other and held down against the back panel 14 out of the path of the product to be inserted into the box. The bottom panel 25 and the bottom closure flaps are likewise held out of the said path. The inner bottom panel 33 is held in a raised position which creates a tubular opening or channel formed by the inner central panel 16 and the side frame members 28. The product, shown herein as a tubular container with a rounded top, is now inserted into the box. The closure flaps **11*c* and 13*c* are folded first over the bottom of the container followed by the inner bottom panel 33, bottom panel 25 and closure flap 25*b* (FIG. 5). The inner bottom panel 33 reinforces the bottom closure so that the container is firmly held against movement in the tubular channel formed in the box (FIGS. 6 and 7**). The stop at the top of the box conforms to the shape of the top of the container and also serves to hold the container in place and prevents any vertical movement of the container in the box.

Although a preferred embodiment of the invention has been disclosed for purpose of illustration, it will be evident that various changes and modifications may be made therein without departing from the scope and spirit of the invention.

What is claimed:

1. A shadow box formed from a precut and prescored blank, which box is adapted to hold and display a product, the said box comprising:

a front and back panel joined by two side panels to form a hollow body;

top and bottom closure panels and flaps;

an inner central panel substantially parallel to and between the front and back panels, the said central panel being cut out to provide an opening conforming generally to the shape of the product inserted into the box, with the lower portion of the said panel being hinged so that the panel and opening form a recess for the bottom of the product inserted in the box; and an inner bottom panel connected to the bottom of the inner central panel; the said inner bottom panel being adapted to raise the lower portion of the inner central panel for insertion of the product into the bottom of the box and being positioned to fold into the bottom closure flaps and reinforce such closure;

the front panel being cut out to provide a top edge, a bottom edge and side flaps separated by a vertical cut line, the said side flaps folding inwardly to frame the product displayed in the box, the said top edge extending below the top of the product and the bottom edge extending above the bottom of the product so that the product is held at top and bottom within the box.

2. The box of claim 1 in which the side flaps in the front panel are scored vertically so that they will assume the contour of the product displayed in the box.

3. The box of claim 1 in which there is a stop interposed between the front panel and the inner central panel, which stop is positioned to contact the top of the product packaged in the box, the said stop preventing any vertical movement of the product in the box.

4. The box of claim 3 in which the portion of the stop contacting the top of the product is shaped to conform to the shape of the top of the product.

5. A one piece blank made of paperboard and adapted to be folded into a shadow box to hold and display a product comprising:

a first side panel, front panel, second side panel, back panel, inner first side panel, inner central panel, and inner second side panel interconnected along hinge score lines;

top and bottom panels connected to the front panel along hinge score lines;

top and bottom closure flaps connected to the side panels and to the top and bottom panels;

the said panels adapted to be folded and glued to provide a hollow body with the inner central panel substantially parallel and between the front and back panels;

the said inner central panel being cut out to provide an opening conforming generally to the shape of the product to be inserted in the box, with the lower portion of the said panel being hinged so that the panel and opening form a recess for the bottom of the product when the blank is set up into a box and the product is inserted in the box; and an inner bottom panel connected to the bottom of the inner central panel, the said inner bottom panel being adapted to raise the lower portion of the inner central panel when the blank is set up into a box and the product is to be inserted into the box and being positioned to fold into the bottom closure flaps and reinforce such closure;

the front panel being cut out to provide a top edge, a bottom edge and side flaps separated by a vertical cut line, the said side flaps being folded inwardly when the blank is set up into a box to frame the product displayed in the box, the said top edge extending below the top of the product and the bottom edge extending above the bottom of the product so that the product is held at top and bottom within the box when the blank is set up into a box.

6. The blank of claim 5 in which there is a stop panel assembly connected to the top of the said inner central panel adapted to be folded when the blank is set up into a box to provide a stop interposed between the front panel and the inner central panel and positioned to contact the top of the product packaged in the box, which stop prevents any vertical movement of the product in the box.

* * * * *